United States Patent [19]

Vuillaume

[11] Patent Number: 5,054,349

[45] Date of Patent: Oct. 8, 1991

[54] PROCEDURE AND APPARATUS FOR PERFORATING A PRODUCT IN SHEETS AND PERFORATED PRODUCT OBTAINED LIKE THIS

[76] Inventor: Andre Vuillaume, 63 Clos des Franquieres, Biviers (Isere), France

[21] Appl. No.: 326,292

[22] Filed: Mar. 21, 1989

[51] Int. Cl.[5] ..... B26F 3/00

[52] U.S. Cl. ..... 83/177; 83/53; 83/938

[58] Field of Search ..... 83/177, 53, 22, 936–941

[56] References Cited

U.S. PATENT DOCUMENTS 2,862,251 12/1958 Kalwaites ..... 83/53

3,136,649 6/1964 Keahey, Jr. ..... 83/53

3,876,324 4/1975 Ballard ..... 83/53

4,693,153 9/1987 Wainwright et al. ..... 83/53

*Primary Examiner*—Frank T. Yost

*Assistant Examiner*—Scott A. Smith

*Attorney, Agent, or Firm*—Weintraub DuRoss & Brady

[57] ABSTRACT

The invention concerns a fixed injector which sends water under pressure to a nonwoven sheet, or workpiece. The injector directs pressurized water through a perforated cylinder, which directs water through a perforated sheet onto a workpiece. This apparatus provides micro-perforation or cuts, of diverse materials, including those of plastic and supple sheets.

9 Claims, 2 Drawing Sheets

FIG 2
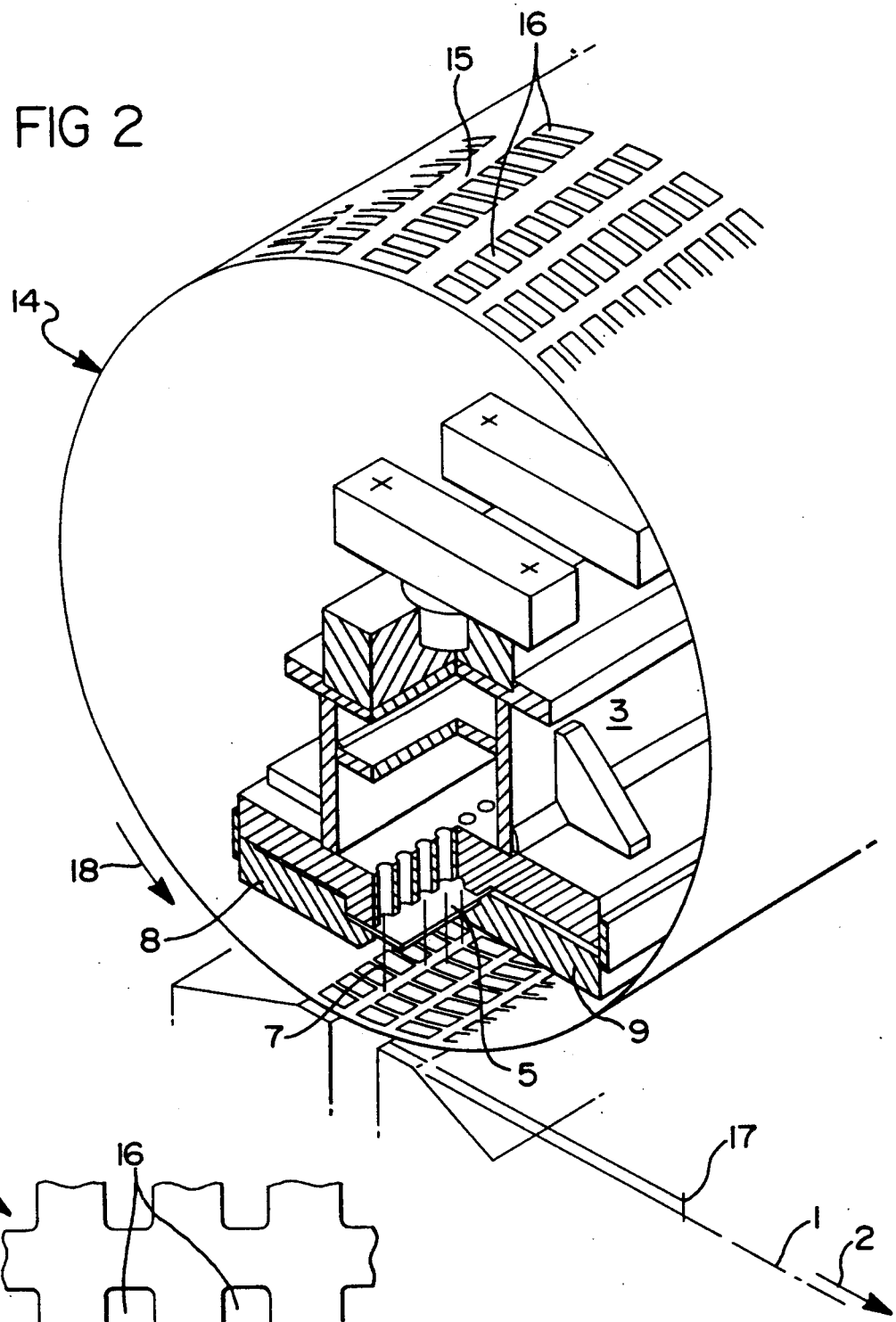
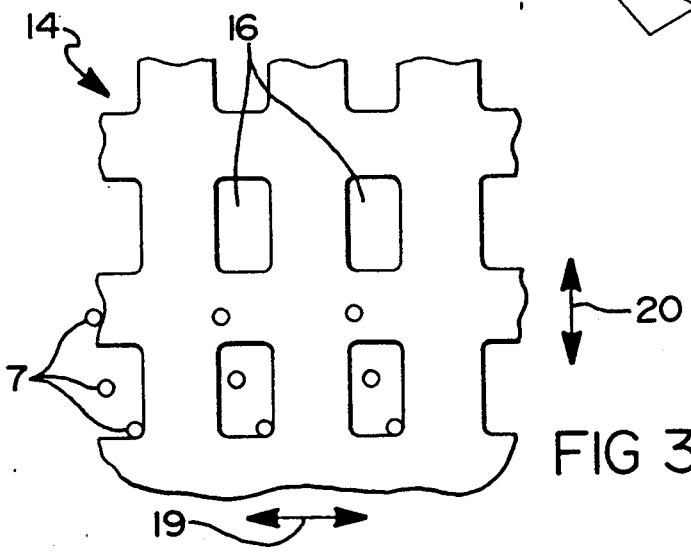
FIG 3

PROCEDURE AND APPARATUS FOR PERFORATING A PRODUCT IN SHEETS AND PERFORATED PRODUCT OBTAINED LIKE THIS

BACKGROUND OF THE INVENTION

1. Field of the Invention

The present invention concerns a universal procedure, for making sheets that are completely or incompletely perforated. The sheet may be pierced by multiple perforations, or may present, a drawing with motifs in hollow or relief.

It is well understood that this new procedure may be used on a sheet of material of any type, Examples being paper, cardboard, unwoven fabric, film, a sheet of plastic material or a sheet of wood or plywood.

The invention equally concerns new industrial products obtained following this method, and possessing original characteristics that cannot possibly be obtained with the traditional known methods.

2. Prior Art

It is known to make unwoven material, presenting some perforations or having areas of reduced density fibers, notably for application in the medical or hospital field realm, for wiping, for filtration, for tea bags etc. For this, it is known, for example in the French letters patent 2,068,676, to circulate a fiber cloth on the porous linen of a support carrier. The cloth is treated while passing under a perforated rotating cylinder, at the interior, where a hydraulic injector is arranged. This injector projects under pressure, a continued curtain of water, which crosses the holes of the perforated cylinder, creating jets of water whose dimension corresponds to that of the perforations. These water jets cross the fiber cloth while reproducing the form of the holes of the cylinder on the material before being collected by a suction case situated under the carrier linen, underneath the rotating cylinder.

Such a known apparatus presents major disadvantages. In effect, the use of an injector supplying a continuous wave of water on all the generators of the cylinder expressed by the release of a considerable flow of water inside of it. The perforated parts of the cylinder represent but a weak part of the surface of as a result presents a practically insolvable problem, which is the elimination at the interior of the cylinder, of the water thrown back by the full parts.

In order to limit the problem, one is driven to lessen the quantity of water emitted by the injector, or reduce the depth of the curtain of water, and the pressure of the water. This results in obtaining at the outside of the cylinder, some water sprays that do not possess a sufficient kinetic energy for perforating some materials of the plastic film type, fabrics, even thick paper.

The water that rebounds on the filled parts of the cylinder the length of the same generator equally disturbs the cohesion of the water curtain and considerably affects the kinetic energy of the water sprays emitted by the cylinder. In effect, the water has a tendency to fall again in a random manner in the cylinder after rebounding. This is evidenced by a disorderly accumulation of water the length of the generator in the cylinder situated to the right of the water curtain.

This excess water acts as a shock absorber against the water emitted by the injector which reduces its kinetic energy to a level such that it becomes insufficient for assuring a uniform marking of the sheet at this point. As a result, areas appear on the treated sheet presenting a washed out quality and the pattern of perforations is poorly defined.

The present invention avoids these disadvantages, realizing a machine practically universal for making papers, unwoven fabrics, textiles or perforated plastic films or possessing motifs in hollow or relief.

SUMMARY OF THE INVENTION

An apparatus according to the invention comprises a support linen for the treating sheets which advance with the material under a resolving perforated cylinder. Inside the cylinder is arranged an injector of fixed water oriented transversally for projecting water under pressure through the perforations of the cylinder in the direction of the treating sheet. The hydraulic injector comprises, a water arrival chamber at high pressure that forces the water back against a perforated sheet whose holes direct the needles of water then directed opposite the holes of an assembly of swingle/rudder bars and of straps/braces placed the length of the injector. A joint, situated between the perforated sheet and the main body of the injector steadies the ensemble water tightness. To free the securing jaw/chaps from the perforated sheet the oil pressure in the hydraulic lifts is lessened so that it is possible to extract the perforated sheet easily, from the stay/brace following the longitudinal direction of the injector, or transversally with respect to the advancement direction of the material and sheet.

According to another characteristic of the invention, the needles of water provided by the hydraulic injector are set out across from the cylinder's holes, staggered following one or more of its generators, in a manner to be the most spaced apart, and to avoid, as much as possible, parasite phenomena owed to the reflection of the water on the full parts of the cylinder, and to limit the flow of water.

According to another characteristic of the invention, the diameter of the holes of the perforated sheet, measure between 50 and 500 microns. In the case of prior products, to present a perforation of a superior size at a nominal dimension of the needles of water, a pierced perforated sheet of holes is set out following many distinct generators, the holes of the sheet being always situated across from those of the cylinder, so that the water emitted by the injector integrally covered the width of the cylinder's holes.

According to another characteristic of the invention, the perforated sheet is easily pulled away from the body of the injector: the perforated sheet is tightly held against the principal body of the injector due to the action of hydraulic jacks which pull the sheet toward the top by the intermediary of an ensemble of swingle bars into stays/braces set out the length of the injector. A joint, situated between the perforated sheet and the principal body of the injector steadies the water tightness of the ensemble. It suffices to lessen the pressure of the oil in the hydraulic jack, to free the securing jaws/-chaps of the perforated sheet so that it is possible to extract the perforated sheet easily, while pulling along the longitudinal direction of the injector, or transversally with respect to the advancement direction of the materials and sheets.

According to another characteristic of the invention, the water pressure in the principal body of the injector is comprised between two and five hundred bars when the material to be treated is thick and should be perforated, or simply marked with a jet of water.

According to another characteristic of the invention, the perforated cylinder can be in contact with the treating sheet or workpiece, or can released from it in a manner such that its rotation speed can be independent of the displacement speed of the sheet or workpiece. The active power to modify the rotation speed of the cylinder with respect to the sheet or workpiece results in a variable number of cylinder holes passing to the right of the water jets emitted by the hydraulic injector. This results in a hydraulic obturator having variable speed and the possibility to obtain, from one cylinder comprising a number of holes determined at $cm^2$, a sheet possessing a number of holes totally different from $cm^2$, and in particular, micro-holes, such which are absolutely impossible obtain with conventional methods, when the cylinder speeds and the treating sheet are identical.

The perforated cylinder can be of any material, for example stainless steel, bronze, or preferably of nickel. This enumeration is not restrictive. It can also be of the same of the type of well known silkscreen cylinders utilized in the textile and printing or for the deposits of plastic material in relief on the surface of the ground: the only limit is its mechanical resistance to the action of the water needles emitted by the hydraulic injector.

The attached drawing, given by way of non-limiting example, permits one to better comprehend the characteristics of the invention, and the advantages which it is susceptible of procuring.

BRIEF DESCRIPTION OF THE DRAWINGS

FIG. 2 represents an injector according to the invention, set out at the interior of the hollow cylinder perforated with rectangular holes set out in helicoid, in a manner such that the needles of water emitted by the injector are situated alternatively in front of a full part and a perforated part of the cylinder.

FIG. 3 represents a perforated sheet with three rows of holes staggered one in relation to the other, in a way to integrally re-cover the perforated parts of the cylinder.

DETAILED DESCRIPTION OF THE PREFERRED EMBODIMENT

Figure 1:
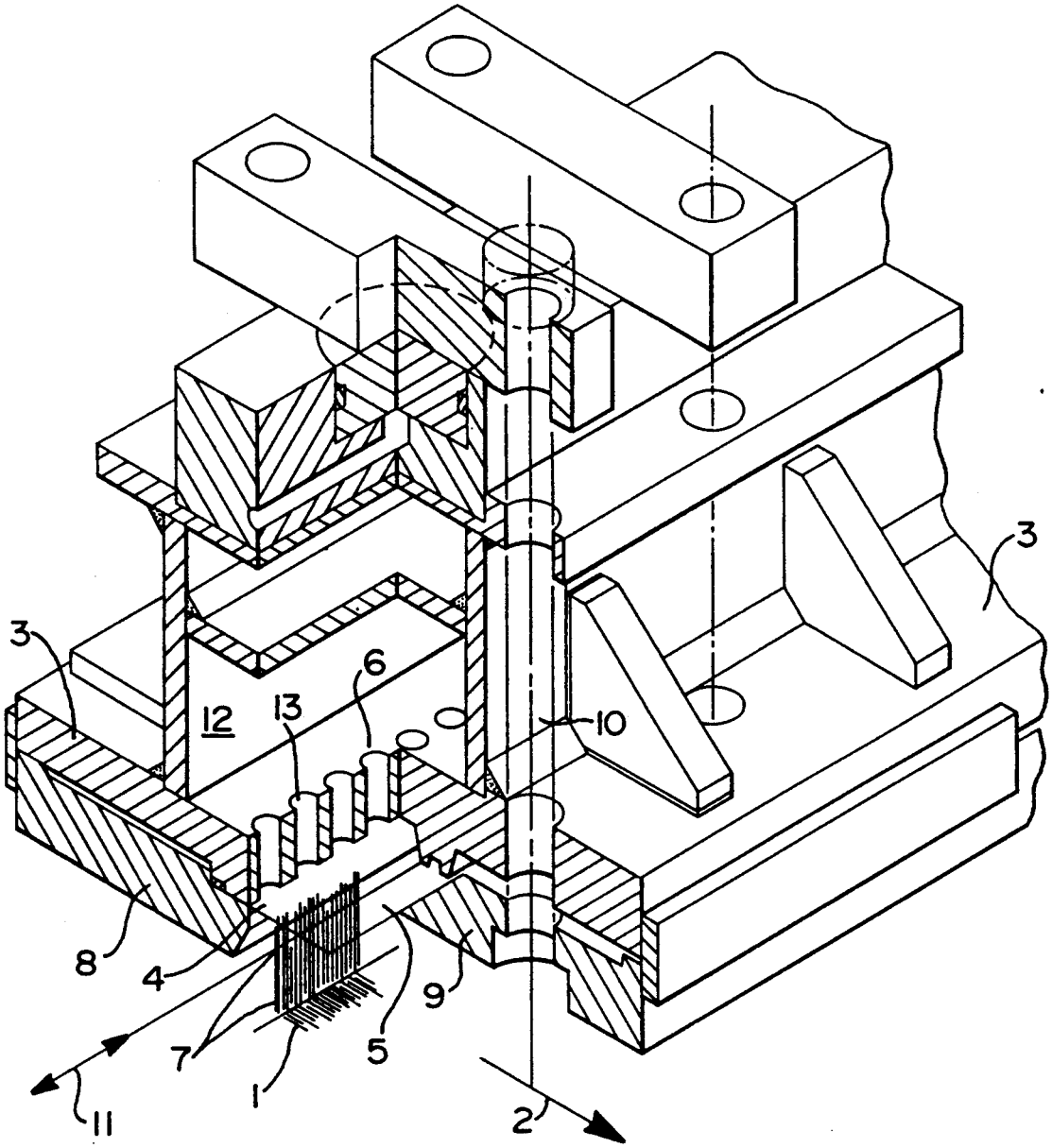
FIG. 1 is a view of an injector according to the invention, comprising a perforated sheet with holes set out according to three generators of the cylinder.

Represented in FIG. 1, is a sheet 1, for example of nonwoven fabric, which advances in the longitudinal sense represented by arrow 2. Tranversally and above sheet 1, is located the fixed elongated body 3 of an injector in which is defined a chamber of water 4. Its inferior bottom is constituted by a sheet 5 against the body 3 of the injector. The sheet is secured to ensure the water tightness of the assembly of the sheet 5 against the body of the injector 3, when the ensemble is against the surface. The sheet 5, is secured by a means comprising at least one pair of jaws 8, 9, secured by at least one hydraulic jack 10, which causes the jaws 8, 9 to pull the sheet 5 through at least one pair of swingle bars, (not shown) placed the length of the injector 3. For cleaning and maintenance, it suffices to loosen the jacks 10, to conveniently extract the sheet 5, while transversally pulling the sheet, as indicated by arrow 2. A chamber of water 4 is, for example, surmounted by a feeding chamber of water 12, with which it communicates per large orifices 13.

In the example of FIG. 2, the hydraulic injector 3 is mounted at a fixed post at the interior of the rotating cylinder 14 on the thin wall of the cylinder 15 from which the orifices 16 are distributed.

According to an important characteristic of the invention, the wall 15 of the cylinder 14 can be at a certain distance 17 above the superior face of the sheet 1. The tangential speed of the rotating cylinder 14 (arrow 18) is independent of the forward speed of the sheet 1 or workpiece (arrow 2).

EXAMPLES

Example 1

A nonwoven sheet 1 of 18 $g/m^2$ obtained by the process called "wet process" is supported by a bronze linen of a knitted type, comprising 32 threads in the chain sense and 27 threads in the weft sense. This sheet is subject to the action of the apparatus represented in FIGS. 2 and 3.

The perforated cylinder 14 presents orifices 16 of rectangular section of 0.8 mm in the axial sense (arrow 19), and 1.3 mm in the tangential sense (arrow 20), the distance between the orifices being 0.8 mm in both directions.

The cylinder's (14) thickness is 0.4 mm and the orifice section is identical to the interior and the exterior of the cylinder.

The hydraulic injector comprises a perforated sheet 5 of 0.3 mm a thickness comprising 3 rows of holes of a diameter of 0.28 mm spaced from one point 6 mm (from access to access) following a generator, and of 1 mm between the generators (see FIG. 3).

The water pressure in the injector 3 is 3.5 bars (chambers 4 and 12). The cylinder 14 is maintained at 0.5 mm above sheet 1 and its tangential speed of rotation (arrow 18) is equal to the forward speed of sheet 1 (arrow 2).

The treatment of sheet 1 effectuated in these conditions permits the obtaining of a sheet presenting a design absolutely perfect and uniform in corresponding to the perforations of the cylinder 14 and the entire surface of sheet 1.

A similar treatment, which does not obtain good results is effectuated on the same sheet 1, but with replacing the needle injector 7 with an injector of "curtained" type delivering a continuous curtain of water of 0.12 mm thickness following the entire length of the sheet. This obtains good results, as numerous parts of the sheet 1 present a washed out aspect.

Example 2

A plastic sheet of 30 microns of thickness is utilized using the preceding apparatus.

The same cylinder 14 as before is utilized.

The sheet 1 is posed on a stainless steel support linen of the type "united", comprising seven threads at cm, in the senses chain and weft.

The perforated sheet 5 of the injector comprises a single row of holes 6, of 0.12 mm in diameter all spaced of 1.6 mm.

The perforated sheet 5 is positioned in such a way that the needles of water 7 find themselves situated approximately at the middle of the orifices 16 of the perforated cylinder 14. The water pressure in the injector is 150 bars and the treatment speed at 25 meters/mm.

The cylinder is situated at 1 mm above the linen (interval 17), and its tangential speed of rotation (arrow 18)

is equal to the forward speed of the sheet 1 and of its linen (arrow 2).

The plastic sheet 1 is perforated in the form of fine rectangular cuts, of 0.8 mm in length and of non-measureable width.

The resistance in the transversal direction of the sheet 1 is considerably reduced, and its porousness is very augmented.

After perforation, when the sheet 1 is submitted to a jet of water it is no longer impermeable.

Example 3

The same sheet 1 is submitted to a similar treatment. The only difference with the preceding treatment is the cylinder's rotation speed 14 which gives a tangential speed (arrow 18) of 120 meters per minute (being more or less 5 times the forward speed of the sheet 1) (arrow 2).

The other conditions remain unchanged.

The plastic sheet 1 is now perforated by a multitude of little holes whose dimensions are not measurable.

The permeability of the sheet to air is excellent, and its transversal resistance is little effected. The sheet subjected to a jet of water remains equally impermeable. Lastly, the plastic film has lost its "sounding" characteristic.

I claim:

1. An apparatus for forming perforations in a material, utilizing pressurized fluid comprising:

(a) means for forming a stream of pressurized fluid;

(b) means for directing the pressurized fluid through a material to be perforated, the means for directing having a plurality of perforations formed therein, the fluid being directed therethrough to perforate the material, (c) means for interrupting the flow of pressurized fluid through the means for directing; and (d) means for moving the material to be perforated into the flow of the pressurized fluid.

2. The apparatus of claim 1 wherein the means for forming a stream of pressurized fluid comprises a hydraulic injector which delivers a supply of pressurized fluid to the means for directing.

3. The apparatus of claim 2 wherein the means for directing comprises a rotatable cylinder, having perforations formed therein.

4. The apparatus of claim 3 wherein the rotating cylinder surrounds the injector.

5. The apparatus of claim 3 wherein the means for interrupting the flow of pressurized fluid comprises:

a sheet having perforated and non-perforated sections, said sheet disposed between the means for forming a stream of pressurized fluid and the means for directing fluid to the material to be perforated, and wherein the non-perforated portion of the sheet interrupts flow to the material to be perforated when the pressurized fluid impinges thereon.

6. The apparatus of claim 5 wherein means for directing the pressurized fluid through a material is operable at a speed variable from the displacement speed of the means for moving the material to be perforated.

7. The apparatus of claim 6 wherein the hydraulic injector delivers a supply of pressurized fluid to the sheet having perforated and non-perforated sections and wherein the sheet delivers the pressurized fluid to the rotatable cylinder which then delivers the pressurized fluid onto the material to be perforated located below the rotatable cylinder.

8. The apparatus of claim 1 which further comprises means for securing the material to be perforated in position.

9. The apparatus of claim 8, wherein the means for securing comprises:

at least one pair of jaws;

at least one hydraulic jack, the jaws being secured by the at least one jack, at least one pair of swingle bars, the jack pulling the sheet through the bars, and a pair of braces disposed on the means for forming a stream of pressurized fluid, the at least one jack pulling the sheet through the bars and into the braces.

* * * * *